US005297343A

United States Patent [19]

Melter et al.

[11] Patent Number: 5,297,343

[45] Date of Patent: Mar. 29, 1994

[54] TRIMMING SCISSORS AND SHEATH ASSEMBLY

[75] Inventors: Craig H. Melter, Baraboo; Charles S. Ramsey, Wausau, both of Wis.

[73] Assignee: Fiskars Oy Ab, Helsinki, Finland

[21] Appl. No.: 1,498

[22] Filed: Jan. 7, 1993

[51] Int. Cl.[5] ..... B26B 13/00

[52] U.S. Cl. ..... 30/262; 30/261; 30/151; 30/143

[58] Field of Search ..... 30/233, 254, 261, 262, 30/257, 151, 143

[56] References Cited

U.S. PATENT DOCUMENTS

| | | | |
|---|---|---|---|
| 1,426,214 | 8/1922 | Rausse | 30/262 |
| 2,638,669 | 5/1953 | Steede | 30/262 |
| 2,859,516 | 11/1958 | McQueary | 30/151 |
| 3,339,281 | 9/1967 | Chow | 30/262 |
| 3,416,226 | 12/1968 | Pfaffenbach | 30/262 |
| 4,268,963 | 5/1981 | Harrison | 30/262 |
| 4,916,815 | 4/1990 | Ohmura | 30/151 |
| 5,179,783 | 1/1993 | Melter | 30/262 |

*Primary Examiner*—Richard K. Seidel
*Assistant Examiner*—Hwei-Siu Payer
*Attorney, Agent, or Firm*—Foley & Lardner

[57] ABSTRACT

A scissors including a first handle assembly and a second handle assembly pivotally interconnected for movement between open and closed positions. A latch mounted on one of the handle assemblies for movement into engagement with the other of the handle assemblies on closing the scissors, the latch being movable on one handle assembly into engagement with the other handle assembly to lock the handles in a closed position and a reversible sheath operatively engaging the handle assemblies to enclose the scissor blades on the handle assemblies.

7 Claims, 3 Drawing Sheets

TRIMMING SCISSORS AND SHEATH ASSEMBLY

FIELD OF THE INVENTION

The present invention relates to a five inch hand operated trimming scissors and more particularly to a lock button for holding the scissors in a closed position and a reversible sheath for enclosing the scissor blades.

RELATED APPLICATION

The present invention is an improvement on U.S. patent application Ser. No. 07/815,287, filed on Dec. 27, 1991, and U.S. patent application Ser. No. 07/978,211, filed on Nov. 17, 1992, which are both assigned to the same assignee of the present invention.

BACKGROUND OF THE INVENTION

Scissors of the type set forth in U.S. patent application Ser. No. 07/815,287 are designed for general household use, more particularly for general sewing and cutting applications. These scissors included an internally mounted thumb actuated button which is movable between open and closed positions on one of the blade assemblies. The scissors are locked in the closed position by moving the button into engagement with a hook mounted on the other handle assembly. In U.S. patent application No. 07/978,211, another household scissors is described on which the lock button was mounted on the top of the first handle assembly for sliding movement into engagement with a catch provided on the other handle assembly.

SUMMARY OF THE PRESENT INVENTION

The trimming scissors according to the present invention is designed for small, delicate trimming where accurate control of the blades is required. The trimming scissors is generally about five inches long and includes an improved lock arrangement to accommodate the small handle assemblies. In this regard a symmetrical lock button has been provided in the form of an "H" which is mounted on one of the blade assemblies for movement into engagement with the other blade assembly. The symmetrical configuration of the lock button simplifies assembly since the lock button can be mounted on the scissors in either position. The lock button is slidable into engagement with a latch on the other blade assembly. The lock button is provided with detents for positively holding the latch in the open position or the locked position. Another advantage of the lock button is the ability to close the scissors with the lock button in the closed position and not damage the lock button.

Another aspect of the invention is the provision of a sheath which is mounted on the blades and locked in place by engagement with a button provided on both sides of the outer surface of each of the blade assemblies. The sheath is also symmetrical and therefore adaptable to be mounted on the blades in either position. The possibility of mounting the sheath in the wrong position on the blades is therefore eliminated. Since the half sections of the sheath are identical, manufacture of the sheath is also simplified. The sheath is provided with a number of holes which allow moisture to escape from the sheath.

A further aspect of the invention is the provision of a hand held handle assembly which provides easier position control of the scissors while cutting as well as a greater cutting force. The handles of the scissors are provided with a cushion material which reduces slippage, increases comfort and thus increases control. It should also be noted that the trimming scissors can be operated by either hand.

Other principal features and advantages of the invention will become apparent to those skilled in the art upon review of the following drawings, the detailed description and the appended claims.

Figure 1:
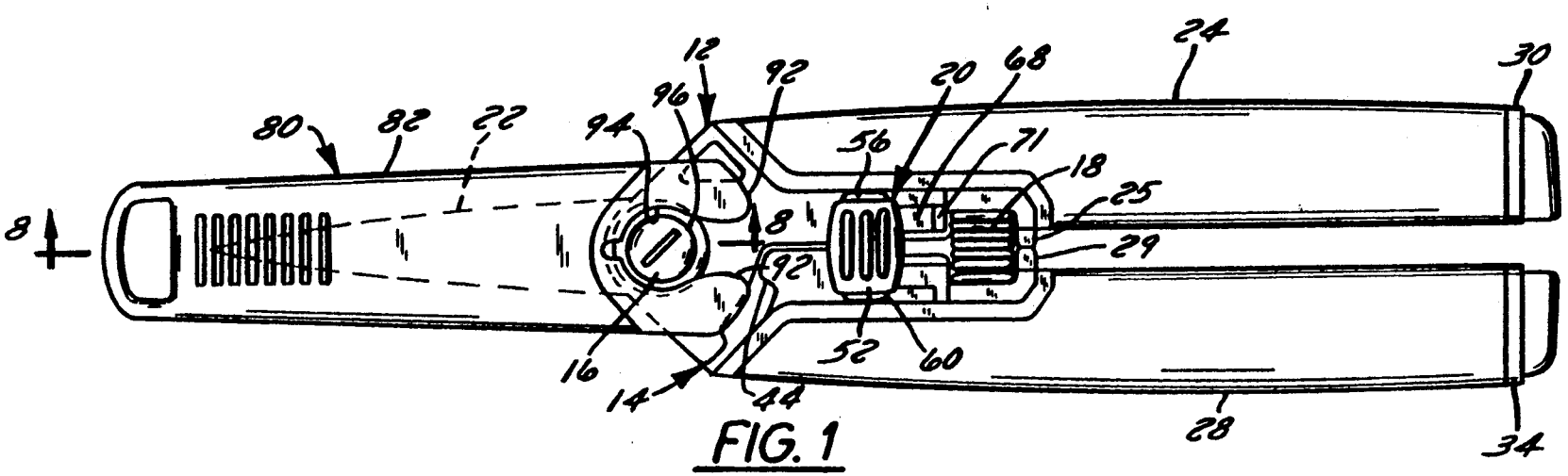
FIG. 1 is a top view of the trimming scissors according to the present invention with the sheath shown mounted on the scissor blades.
Figure 7:
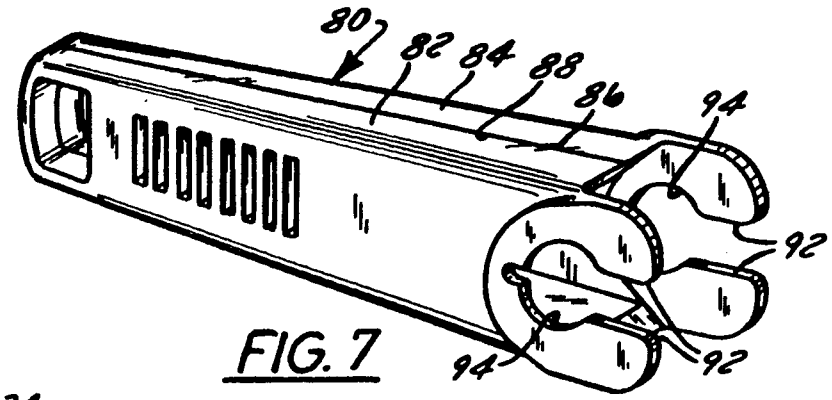
FIG. 7 is a perspective view of the sheath.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

As shown in the drawing the scissors 10 generally includes a first blade assembly 12 and a second blade assembly 14. The blade assemblies are pivotally connected by means of a thread forming screw 16. The blade assemblies are biased to an open position by means of a compression spring 18 and are locked in a closed position by means of a lock button 20.

The first or top blade assembly 12 includes a blade 22 and a handle 24. The second or bottom blade assembly 14 includes a blade 26 and a handle 28. The handle 24 includes a handle section 30 and a mounting section 32. The blade 22 includes a tang 23 which is molded into the blade mounting section 32. The handle 28 includes a handle section 34 and a blade mounting section 36. The blade 26 includes a tang 27 which is molded into the blade mounting section 36.

Figure 8:
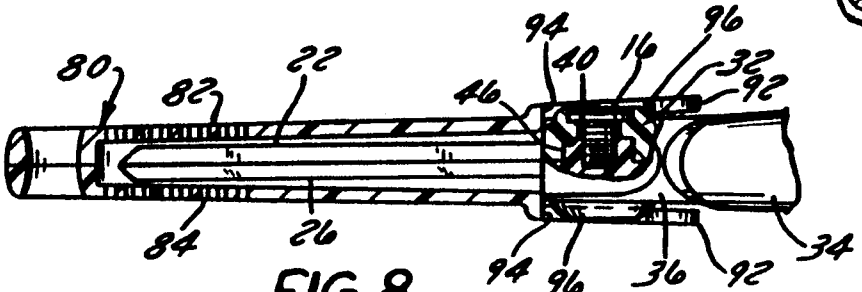
FIG. 8 is a partial section view taken on line 8—8 of FIG. 1.
Figure 2:
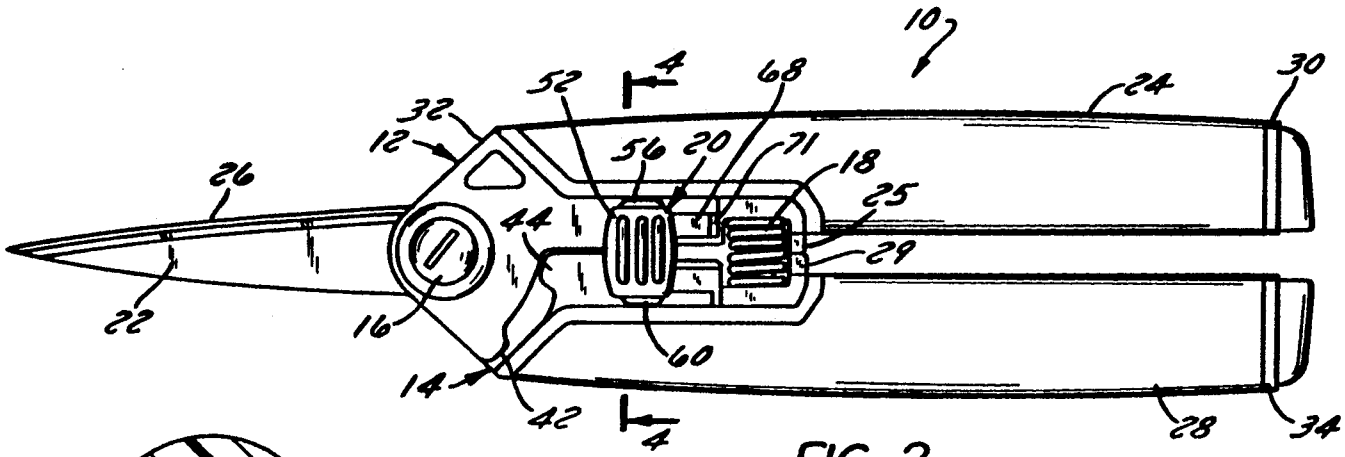
FIG. 2 is a top view of the scissors with the sheath removed.

Referring to FIG. 8 the blade assemblies are shown pivotally connected by a hub 46 molded on the inside of handle section 34 which matingly engages a recess 40 provided in the mounting section 32. The screw 16 is screwed into the hub 46 to seat the hub in the recess 40. The handle sections 30 and 34 may be molded from a fiberglass reinforced nylon material or other similar material and covered with a cushion material such as KRATON TM as shown in FIGS. 1 and 2 to provide a cushion for the hand.

The blade assemblies 12 and 14 are biased to an open position by means of the compression spring 18 which is seated on buttons 45 and 48 provided on the handles 24 and 28, respectively. The closing motion of the blade assemblies 12 and 14 is stopped by stops 25 and 29, respectively, provided on the mounting section. The opening motion of the blade assemblies 12 and 14 is limited by ribs 42 and 44 provided on the mounting sections 32 and 36, respectively.

Figure 6:
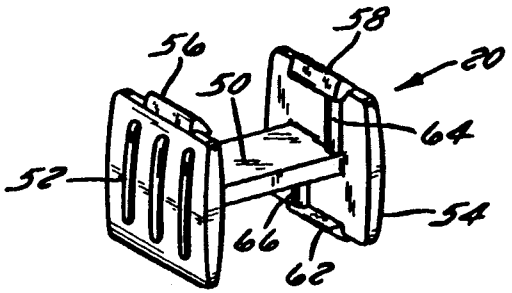
FIG. 6 is a perspective view of the lock button.
Figure 4:
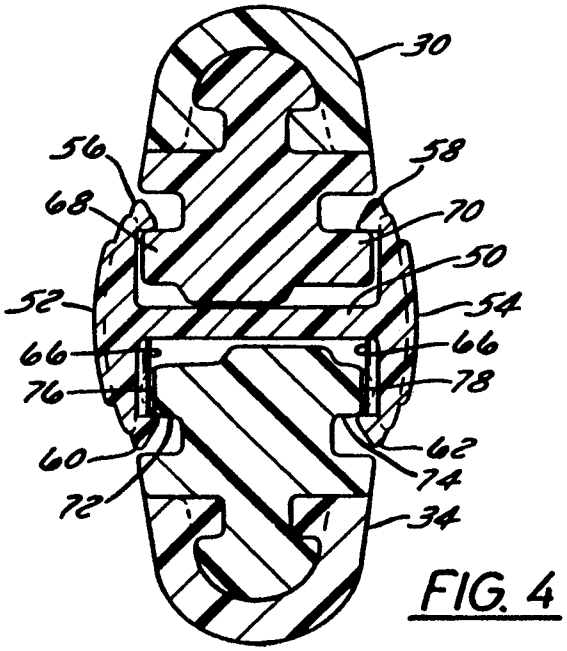
FIG. 4 is a cross sectional view taken on line 4—4 of FIG. 2 with the latch in the locked position.
Figure 3:
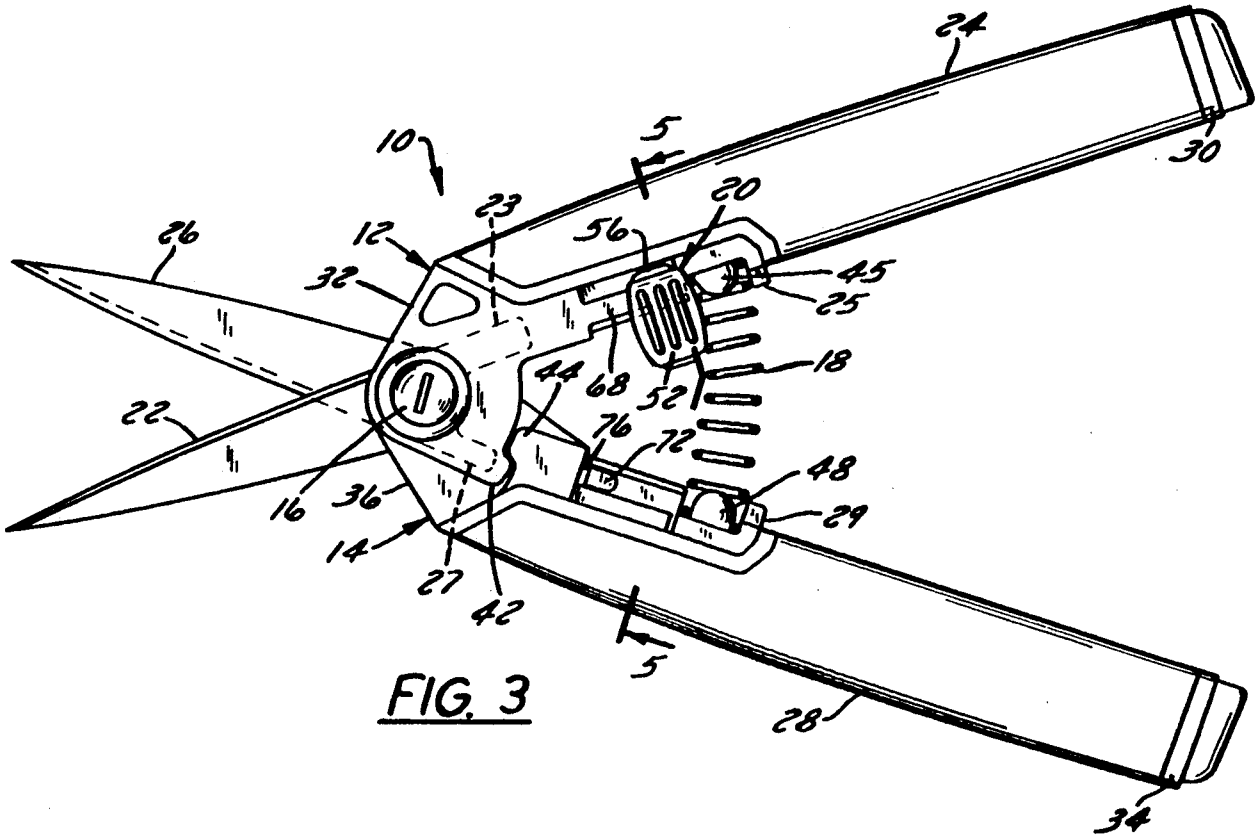
FIG. 3 is a view of the scissors in the open position.

In accordance with the present invention the blade assemblies are locked in the closed position by means of the lock button 20 which is shown in FIG. 3. The lock button as shown in FIG. 6 is in the shape of an "H" having a center section 50 and a pair of legs 52 and 54. A catch 56 and 58 is provided on the upper edge of each of the legs 52 and 54, respectively. A catch 60 and 62 is also provided at the bottom of each of the legs 52 and 54, respectively. A pair of semi circular ribs 64 are provided on the inside surfaces of each of the legs 52 and 54 and a pair of semi circular ribs 66 are provided on the inside bottom portion of each of the legs 52 and 54. The semi circular ribs 64 being offset from the semi circular ribs 66 such that the lock button is symmetrical.

Figure 5:
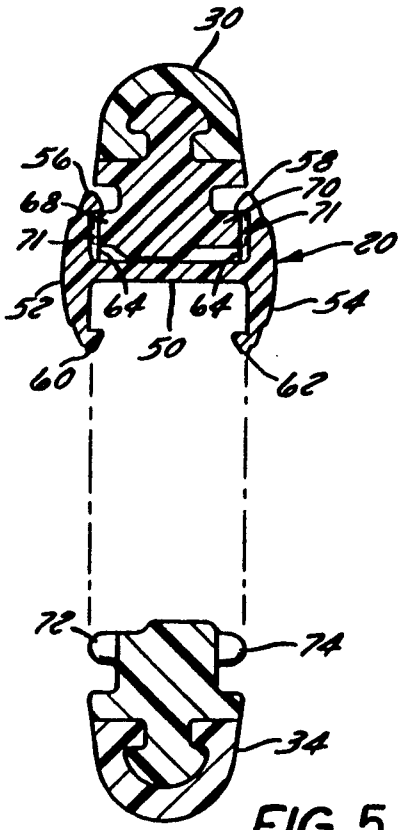
FIG. 5 is a view taken on line 5—5 of FIG. 3 showing the latch in the open position.

The lock button 20 as shown in FIGS. 3 and 5 can be mounted on rails 68 and 70 provided on the handle section 30 in either position. The ribs 64 on the inside of the legs 52 and 54 are seated in notches 71 provided at the end of the rails 68 and 70. Short rails 72 and 74 are provided on the bottom handle assembly 34. Notches 76 and 78 are provided in each of the rails 72 and 74, respectively. The ribs 66 will drop into the notches 76 and 78 when the lock button is moved to the locked position. The catches 60 and 62 will engage the rail 72 and 74 when moved to the locked position, locking the handle in the closed position. The lock button is sufficiently flexible to allow the scissors to be closed when the latch is in the closed position.

In accordance with another aspect of this invention a reversible sheath 80 is provided to enclose the blades when not in use. The sheath is formed from two identical half sections 82 and 84. The sections are secured together along the edges 86 and 88 of the half section. A pair of claws 92 are provided on each half section which define a circular opening 94 within the claw. The sheath is snapped onto a pair of circular buttons or members 96 which are provided on the blade mounting sections 32 and 36 in axial alignment with the pivot screw 16. The sheath is aligned with the blades 22 and 26 and pushed onto the circular members 96 until the openings 94 in the claws 92 are centered on circular members 96. The sheath is also provided with openings 93 on each side to allow for circulation of air through the sheath to prevent corrosion of the blades by moisture. A hole 95 is provided at the end of the sheath for a lanyard or for storage in a hook. It should be noted that the sheath is identical on each side so that it can be reversed or placed on the scissors in either direction.

Thus, it should be apparent that there has been provided in accordance with the present invention a trimming scissors and sheath assembly that fully satisfies the objectives and advantages set forth above. Although the invention has been described in conjunction with specific embodiments thereof it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A trimming scissors comprising a first blade assembly and a second blade assembly, means pivotally connecting said first and second blade assemblies, means biasing said blade assemblies to an open position, and a lock button mounted on said first blade assembly for sliding movement between open and closed positions with respect to said second blade assembly, said first and second blade assemblies each include a blade and a handle, said lock button being mounted on said handle of said first blade assembly for movement into engagement with said handle of said second blade assembly on closing the scissors, said handle of said first blade assembly includes two rails one on the bottom and one on the top thereof, said lock button being mounted on said rails, said handle of said second blade assembly includes two short rails one on the top and one on the bottom thereof which are aligned with the lock button on closing the scissors whereby said lock button can be moved on said rails on said first blade assembly into engagement with said short rails on said second blade assembly to lock the scissors in the closed position.

2. The scissors according to claim 1 wherein each of said rails on said handle of said first blade assembly includes a notch on one end, and said lock button includes two ribs one rib on the top of said button and one rib on the bottom of said button, said ribs being positioned to engage said notches over said handle of said first blade assembly when the lock button is in the open position, and a notch on one end of each of the short rails on the handle of said second blade assembly and two ribs one rib on the top of said button and one rib on the bottom of said lock button for engaging said notches on the short rails to hold the lock button in the locked position.

3. A trimming scissors comprising a first blade assembly including, a first handle having a first handle section and a mounting section and a first blade including a tang molded in said mounting section, and a second blade assembly including a second handle having a second handle section and a mounting section and a second blade including a tang molded in said mounting section, means for pivotally connecting said mounting sections, means for biasing said first blade assembly and said second blade assembly to an open position, means mounted on said mounting sections for limiting the opening motion of said handles, and a lock button mounted on the top and bottom of one of said handle sections, said lock button operatively engaging the top and bottom of the other handle section on closing said first and second blade assemblies, and being slidable on said one of said handle sections between open and closed positions with respect to the other handle section, said first handle includes a rail on the top and a rail on the bottom of said first handle section for supporting said lock button, and said second handle includes a short rail on the top and a short rail on the bottom of said second handle section to engage said lock button when moved to a locked position.

4. The scissors according to claim 3 wherein said top and bottom rails on said first handle each include a notch on one end thereof and said lock button includes two ribs, one rib on the top and one rib on the bottom to engage said notches in said top and bottom rails when moved to the open position.

5. The scissors according to claim 4 including a notch on each short rail and a rib on said lock button to engage said notch when said lock button is moved to the locked position.

6. A trimming scissors comprising a first blade assembly including, a first handle having a handle section and a mounting section and a blade including a tang molded in said mounting section, a second handle having a handle section and a mounting section and a blade including a tang molded in said mounting section, means for pivotally connecting said mounting sections, means for biasing said first blade assembly and said second blade assembly to an open position, means mounted on said mounting sections for limiting the opening motion of said handles, and a lock button mounted on the top and bottom of one of said handle sections, said lock button operatively engaging the top and bottom of the other handle section on closing said blade assemblies, and being slidable on said one of said handle sections between open and closed positions with respect to the other handle section, said lock button is symmetrical whereby said lock button can be mounted on said one of said handle sections in any position.

7. A trimming scissors comprising a first blade assembly including, a first handle having a first handle section and a mounting section and a first blade including a tang molded in said mounting section, and a second blade assembly including a second handle having a second handle section and a mounting section and a second blade including a tang molded in said mounting section, a screw for pivotally connecting said mounting sections, a spring for biasing said first blade assembly and said second blade assembly to an open position, a rib mounted on each of said mounting sections for limiting the opening motion of said handles, and a lock button mounted on the top and bottom of one of said handle sections, said lock button operatively engaging the top and bottom of the other handle section on closing said first and second blade assemblies, and being slidable on said one of said handle sections between open and closed positions with respect to the other handle section, said first handle includes a rail on the top and bottom of said first handle section for supporting said lock button, and said second handle includes a short rail on the top and bottom of said second handle section to engage said lock button when moved to a locked position.

* * * * *